US009093777B2

(12) United States Patent
Kojima

(10) Patent No.: US 9,093,777 B2
(45) Date of Patent: Jul. 28, 2015

(54) CONNECTOR

(75) Inventor: Hiroshi Kojima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/117,899

(22) PCT Filed: May 10, 2012

(86) PCT No.: PCT/JP2012/061948

§ 371 (c)(1),
(2), (4) Date: Nov. 15, 2013

(87) PCT Pub. No.: WO2012/157502

PCT Pub. Date: Nov. 22, 2012

(65) Prior Publication Data

US 2014/0065858 A1 Mar. 6, 2014

(30) Foreign Application Priority Data

May 17, 2011 (JP) ..... 2011-110185

(51) Int. Cl.
*H01R 13/44* (2006.01)
*H01R 13/52* (2006.01)
*H01R 13/447* (2006.01)

(52) U.S. Cl.
CPC ..... *H01R 13/5213* (2013.01); *H01R 13/447* (2013.01)

(58) Field of Classification Search
CPC ..... H01R 2201/26; H01R 13/447; H01R 13/6397; H01R 13/5213; H01R 13/516
USPC ..... 439/131, 142
See application file for complete search history.

(56) References Cited

U.S. PATENT DOCUMENTS 4,381,879 A * 5/1983 Ehrenfels et al. ..... 439/142
5,571,023 A 11/1996 Anthony (Continued)

FOREIGN PATENT DOCUMENTS

JP 2002-216882 A 8/2002
JP 2007-211557 A 8/2007

(Continued)

OTHER PUBLICATIONS

Supplementary European Search Report dated Oct. 6, 2014, issued for the European patent application No. 12785255.6.
International Search Report dated Aug. 7, 2012, issued for PCT/JP2012/061948.

*Primary Examiner* — Xuong Chung Trans
(74) *Attorney, Agent, or Firm* — Locke Lord LLP; James E. Armstrong, IV; Brian S. Matross

(57) ABSTRACT

Provided is a connector in which a cover is readily closed when ice is induced between a pair of shaft attachment plates by such snowfall. A connector mounted in an electric vehicle and connected to a connector of a charge cable is provided with a housing, a cover rotatably pivoted by the housing and covering an opening of the housing, a latch, and shafts. The cover is provided with a pair of shaft attachment plates and a rib arranged between the pair of shaft attachment plates. The rib extends in a direction perpendicular to a direction of the pair of shaft attachment plates being opposed to each other, and formed such that its tip is peaked. In the connector, even when ice is induced, rotation of the cover in closing direction allows the ice to be broken by the rib so as to readily close the cover.

2 Claims, 8 Drawing Sheets

(56) References Cited

U.S. PATENT DOCUMENTS

| | | | | |
|---|---|---|---|---|
| 5,582,521 | A * | 12/1996 | Mori et al. | 439/142 |
| 6,132,227 | A * | 10/2000 | Boteler et al. | 439/142 |
| 6,371,768 | B1 | 4/2002 | Neblett et al. | |
| 2001/0054829 | A1 | 12/2001 | Hagano et al. | |
| 2002/0115319 | A1 | 8/2002 | Mori | |

FOREIGN PATENT DOCUMENTS

| | | |
|---|---|---|
| JP | 2012-009387 A | 1/2012 |
| JP | 2012-109215 A | 6/2012 |

* cited by examiner

CONNECTOR

TECHNICAL FIELD

This invention relates to connectors with cover that are connected with connectors such as charge cables.

BACKGROUND ART

A connector 201 shown in FIGS. 6 to 9 have conventionally been used for electric automobile, and is designed to be connected with a connector 9 of a charge cable for charging a battery of the automobile (see PTL 1).

The connector 201 is provided with a housing 202, a cover 203 pivoted by the housing 202 and covering openings 221*a*, 222*a* of the housing 202, a latch 204 pivoted by the housing 202, holding a state that the cover 203 covers the openings 221*a*, 222*a* by it being engaged with an edge 233 of the cover 203 covering the openings 221*a*, 222*a*, and shafts 207, 208.

The housing 202 is made of synthetic resin, and is provided with a housing main body 220, a flange 223 disposed annually on an outer peripheral face of the housing 220, a pair of attachment plates 224 disposed separated from each other on the outer peripheral face of the housing main body 220, to which the cover 203 is attached, and a pair of attachment plates 225 disposed separated from each other on the outer peripheral face of the housing main body 220, to which the latch 203 is attached. The pair of attachment plates 224 is provided with axis holes through which the shaft 207 is passed. The pair of attachment plates 225 is provided with axis holes through which the shaft is passed.

The housing main body 220 is provided with a plurality of terminal cavities 222, and a housing cavity 221 receiving a hood part of the connector 9 of the charge cable. The terminal cavities 222 extend in a direction engaging with the connector 9 of the charge cable, and at an upper end and a lower end of the housing main body 220 openings 222*a*, 222*b* are formed. From the lower opening 222*b* a terminal with an electric wire (not shown) is inserted, and from the upper opening 222*a* a terminal of the connector 9 of the charge cable (not shown) is inserted. These terminal with electric wire and the terminal of the connector 9 of the charge cable are engaged in the terminal cavity 222.

The cover 203 is made of synthetic resin, and is provided with a plate 232 overlaid on the upper end of the housing main body 220, an edge 233 disposed at an outer edge of the plate 232, and a base 230 disposed at the outer end of the plate 232 opposite to the edge 233. The base 230 as shown in FIG. 9 is provided with an extension part 236 extending from the outer edge of the plate 232, and a pair of shaft attachment plates 237, 238 extending from the extension part 236 and opposed to each other. The pair of shaft attachment plates 237, 238 is provided with axis holes 231 through which the shaft 207 is passed.

Furthermore, the pair of shaft attachment plates 237, 238 is positioned between the pair of attachment plates 224 of the housing 202, and by the shaft 207 being passed through the axis holes 231 of the pair of shaft attachment plates 237, 238 and the axis holes of the pair of attachment plates 224, the cover 203 is pivoted rotatably by the housing 202. The cover 203, when the connector 9 of the charge cable is plugged into the housing 202, opens the openings 221*a*, 222*a*, and, when other then charging, covers the openings 221*a*, 222*a* to prevent water or dirt from entering into the housing 202.

The latch 204 is made of synthetic resin, and is provided with a shaft 241 through which the shaft 208 is passed. This latch 204 is positioned between the pair of attachment plates 225 of the housing 202, through the shaft holes 241 and shaft holes of the pair of attachment plates 225 the shaft 208 is passed, and thus is pivoted rotatably by the housing 202.

CITATION LIST

Patent Literature

[PTL 1]
Japanese Patent Application Laid-Open Publication No. 2002-216882

SUMMARY OF INVENTION

Technical Problem

Disadvantageously, in the above-mentioned conventional connector 201, there have been following drawbacks. Namely, one drawback is that in the connector 201, while the connector 9 of the charge cable is plugged into the housing 9 and charge is taken, water or snow accumulating between the pair of shaft attachment plates 237, 238 (H portion shown in FIG. 7) is such frozen, then ice induced between the pair of shaft attachment plates 237, 238 interferences with the cover 203 being closed when closing the cover 203 after charge.

Therefore, an object of the invention is to provide a connector in which a cover even if ice is induced between a pair of shaft attachment plates by such snowfall can readily be closed.

Solution to Problem

In order to achieve the object, there is provided a connector, including: a housing; a cover rotatably pivoted by the housing and covering an opening of the housing; a pair of shaft attachment plates disposed in the cover, the pair of plates provided with an axis hole passing therethrough a shaft; and a peaked rib disposed between the pair of shaft attachment plates.

Advantageous Effects of Invention

According to the invention, since the pair of shaft attachment plates is disposed in the cover and the peaked rib is disposed between the pair of shaft attachment plates, it is made possible that when ice is, with the cover is opened, induced between the pair of shaft attachment plates by such snowfall, rotation in a direction closing the cover allows the ice to be broken, and thus the cover can readily be closed.

DESCRIPTION OF EMBODIMENTS

Figure 1:
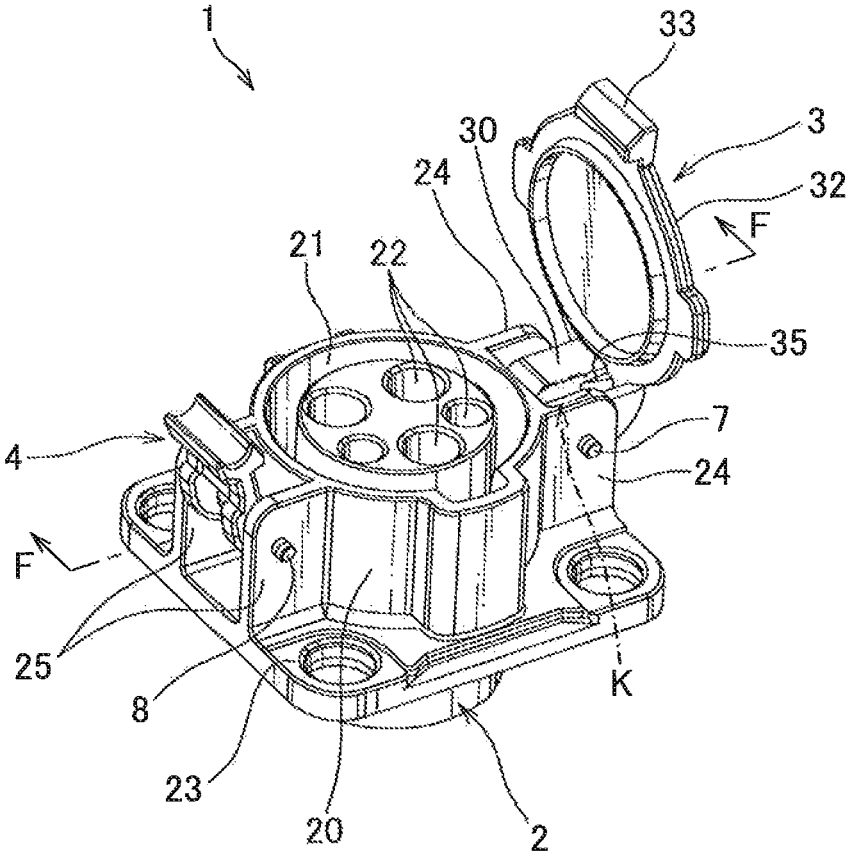
FIG. 1 is a perspective view illustrating a connector according to one embodiment of the invention.
Figure 2:
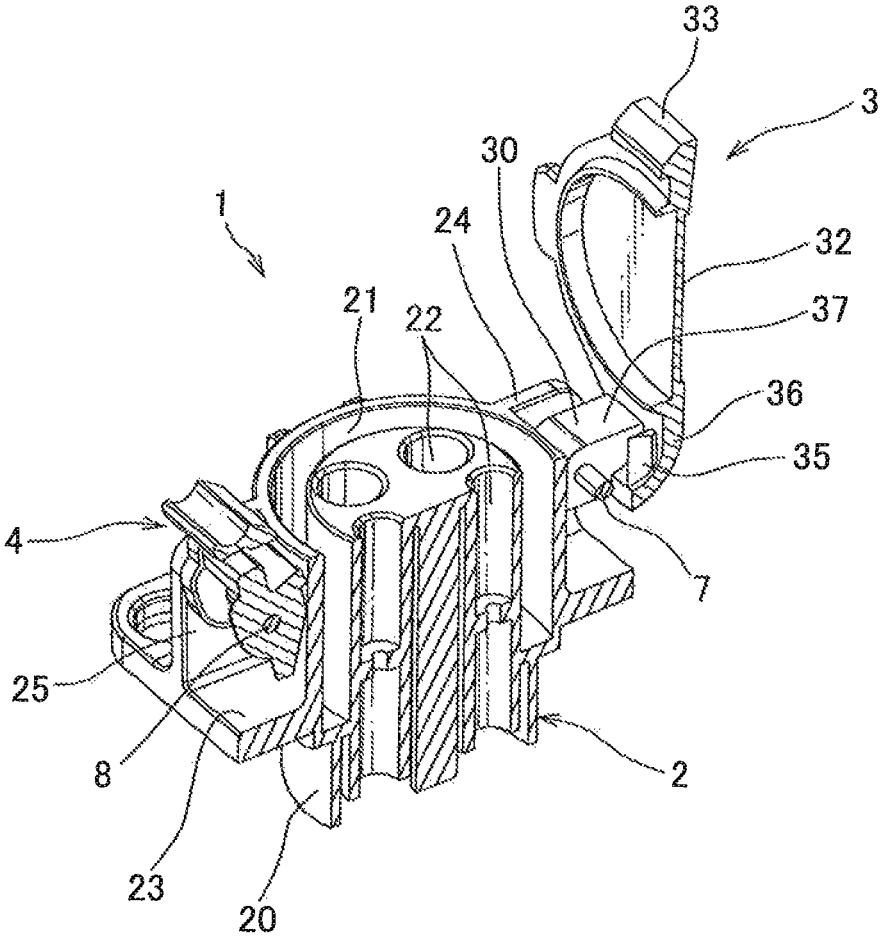
FIG. 2 is a cross-sectional perspective view taken along F-F line in FIG. 1.
Figure 3:
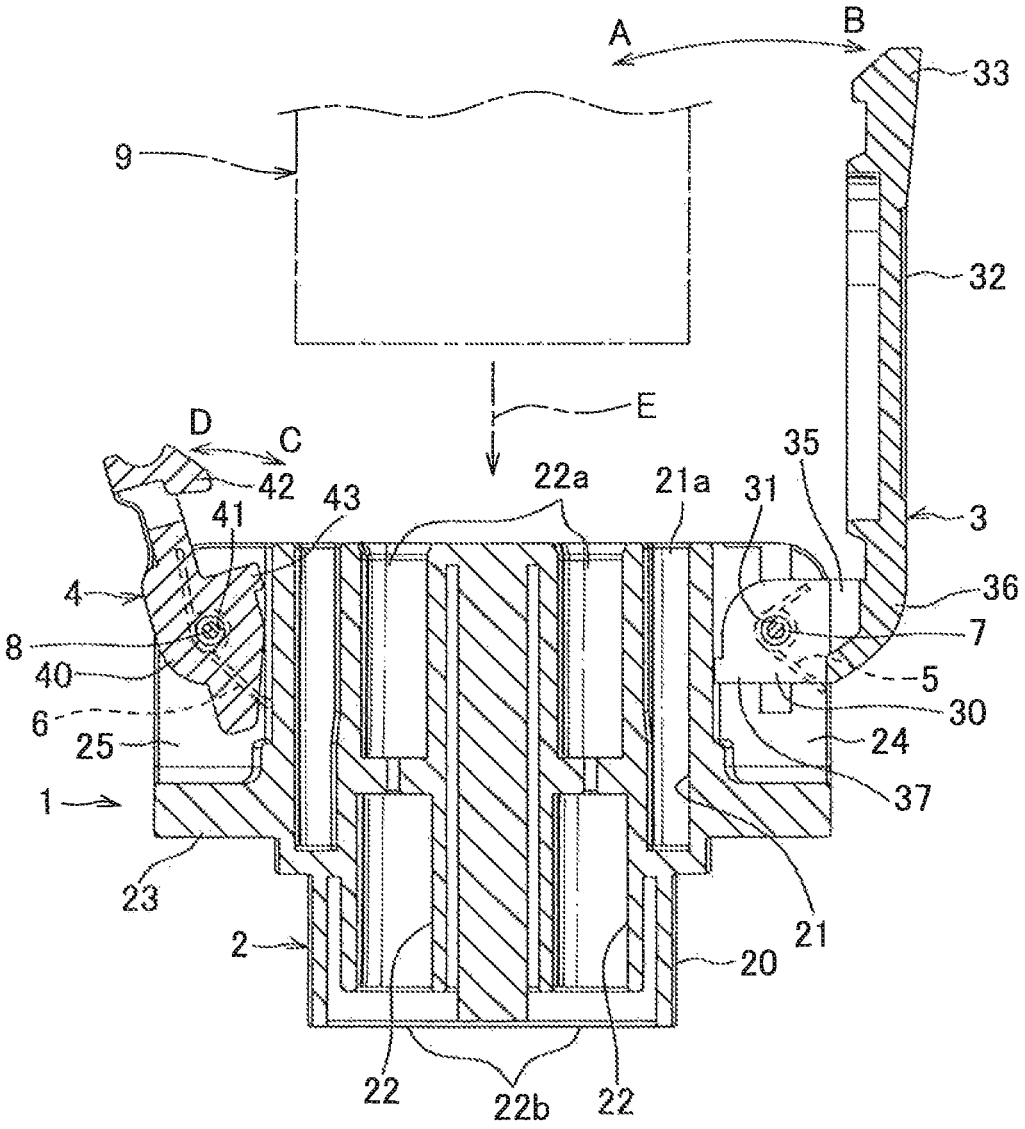
FIG. 3 is a cross-sectional view taken along F-F line in FIG. 1.

With reference now to FIGS. 1 to 5 a "connector" is described related to one embodiment of the invention.

A connector 1 shown in FIGS. 1 to 4 is the one that is mounted to an electric vehicle, and that is connected to a connector 9 of a charge cable (see FIG. 3) for charging a battery of the electric vehicle. The connector 1 is provided with a housing 2, a cover 3 pivoted rotatably by the housing 2 and covering an openings 21*a*, 22*a*, a spring 5 biasing the cover 3 in a direction separating from the openings 21*a*, 22*a*, a latch 4 pivoted rotatably by the housing 2 and keeping the cover 3 covering the openings 21*a*, 22*a* by engaging an edge of the cover with it covering the openings 21*a*, 22*a*, a spring 6 biasing the latch 4 in a direction approaching the openings 21*a*, 22*a*, and shafts 7,8.

The housing 2 is made of synthetic resin, and is provided with a housing main body 20, a flange 23 annually disposed on an outer face of the housing main body 20, a pair of attachment plates 24 disposed separated from each other on the outer face of the housing main body 20, to which the cover 3 is attached, and a pair of attachment plates 25 disposed separated from each other on the outer face of the housing main body 20, to which the latch 4 is attached.

The housing main body 20 is provided with a plurality of terminal cavities 22, and a housing cavities 21 receiving the connector 9 of the charge cable. The terminal cavity 22 extends in an engagement direction of the connector 9 of the charge cable (the arrow E in FIG. 3), and openings 22*a*, 22*b* are formed at upper end and lower end of the housing main body 20, respectively. From the lower end 22*b* a terminal with electric wire (not-shown) is inserted, from the upper opening 22*a* the terminal of the connector 9 of the charge cable 9 (not shown). These terminal with electric wire and the terminal of the connector 9 of the charge cable are engaged within the terminal cavity 22. The housing cavity 21 is formed so as to be recessed from an upper end of the housing 20, and is formed annular to surround the plurality of terminal cavities 22. The housing cavity 21 has a hood (not shown) of the connector 9 of the charge cable inserted therein.

The upper opening 22*a* of the terminal cavity 22 and the opening 21*a* of the housing cavity 21 correspond to "opening" recited in the claims. Namely, the cover 3, when the connector 9 of the charge cable is plugged into the housing 2, opens the openings 21*a*, 22*a*, and, excepting charging, covers the openings 21*a*, 22*a* so as to prevent water or dirt from entering into the housing 2.

The pair of attachment plates 24 is provided with shaft holes through which the shaft 7 is passed. The pair of attachment plates 25 is provided with shaft holes through which the shaft 8 is passed. These pair of attachment plates 24 and pair of attachment plates 25 are arranged in 180-degree turn across a center of the housing main body 20.

Figure 4:
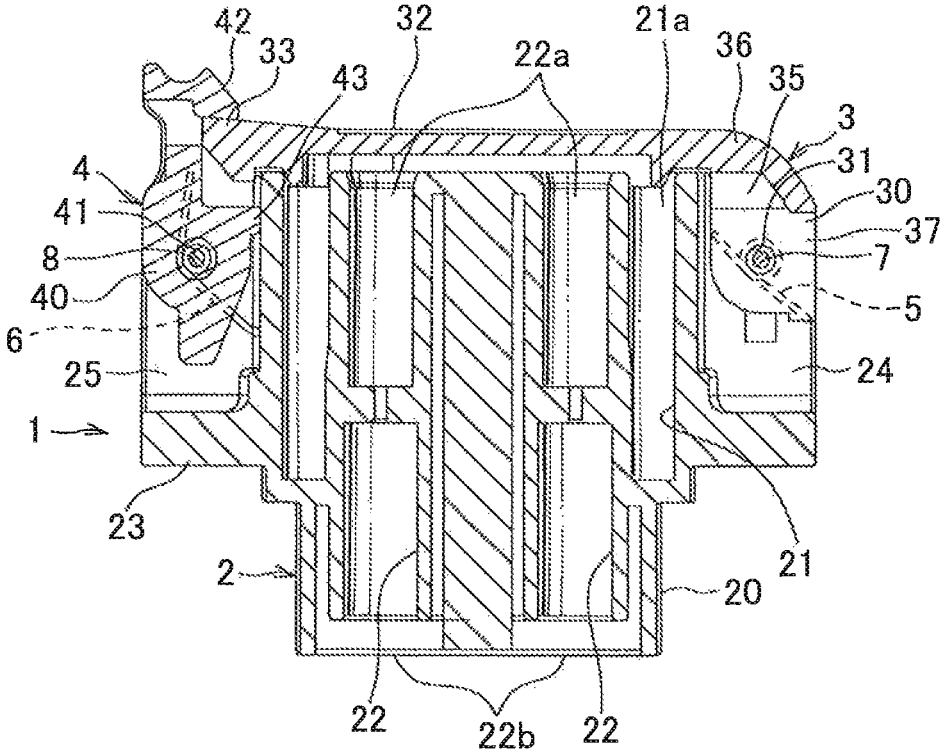
FIG. 4 is a cross-sectional view illustrating a state that a cover of the connector shown in FIG. 3 covers an opening of a housing.
Figure 5:
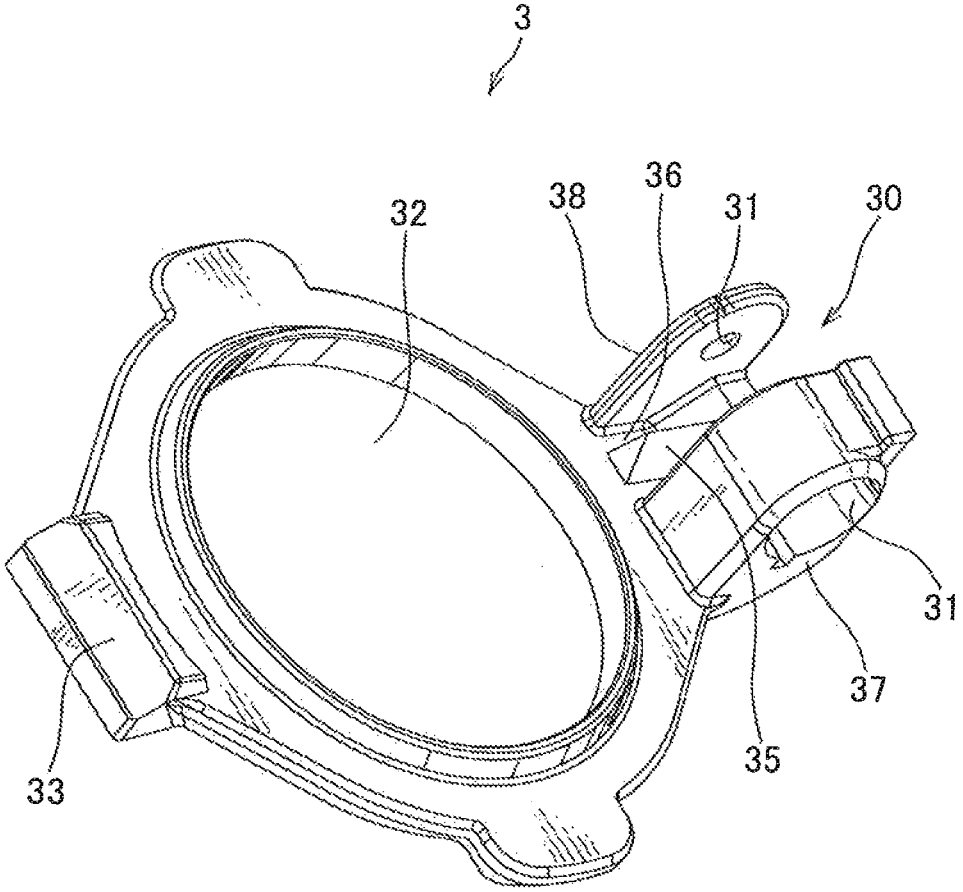
FIG. 5 is a perspective view illustrating a cover of the connector shown in FIG. 1.
Figure 6:
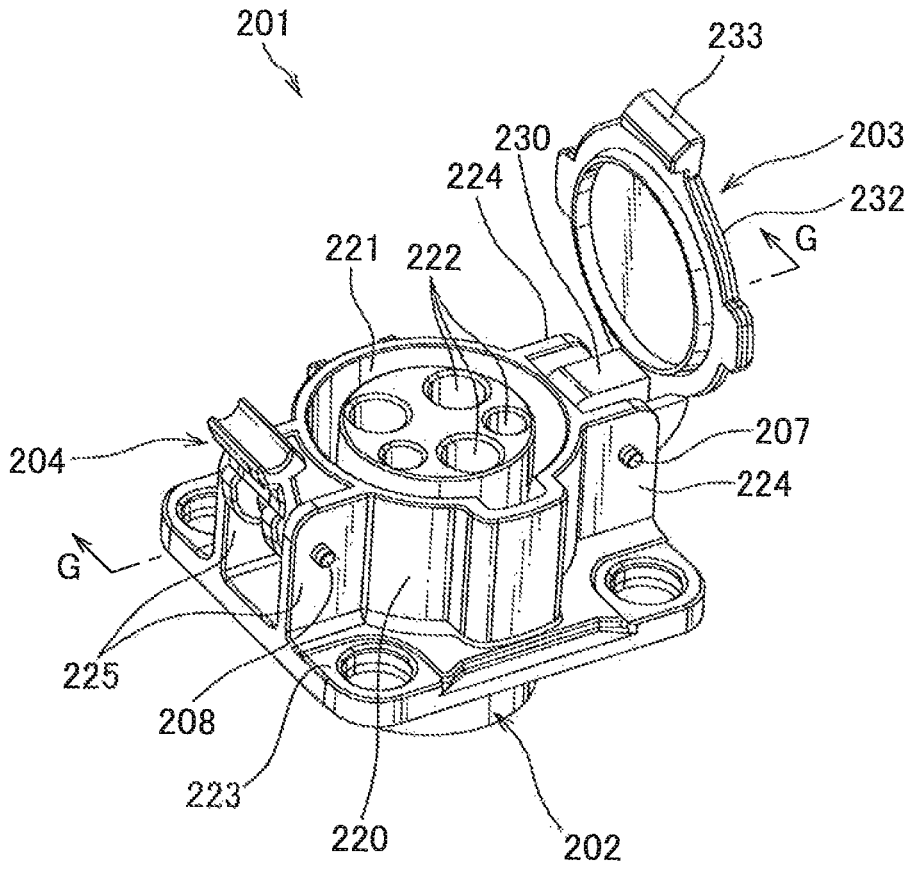
FIG. 6 PRIOR ART
FIG. 6 is a perspective view illustrating a conventional connector.
Figure 7:
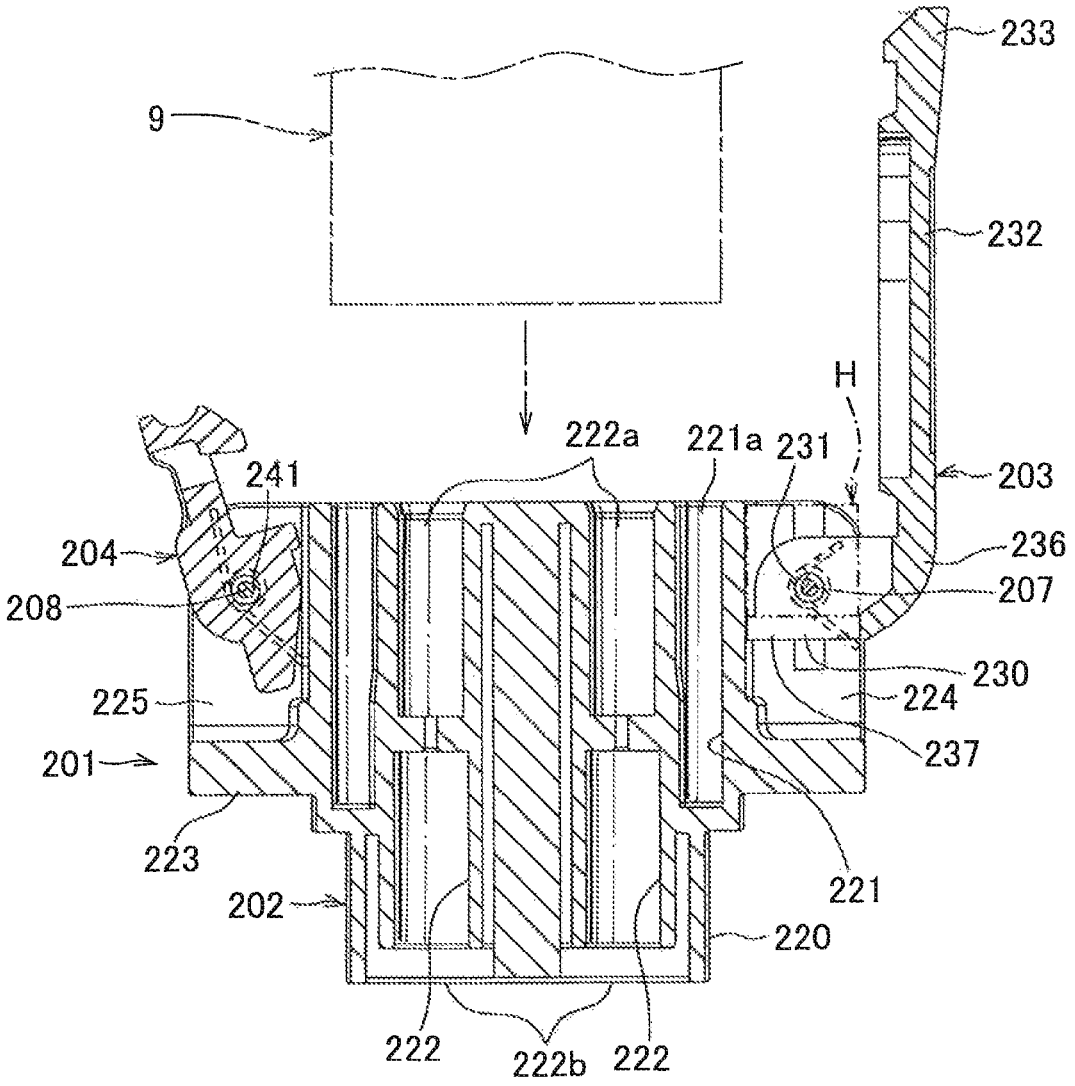
FIG. 7 PRIOR ART
FIG. 7 is a cross-sectional view taken along G-G line shown in FIG. 6.
Figure 8:
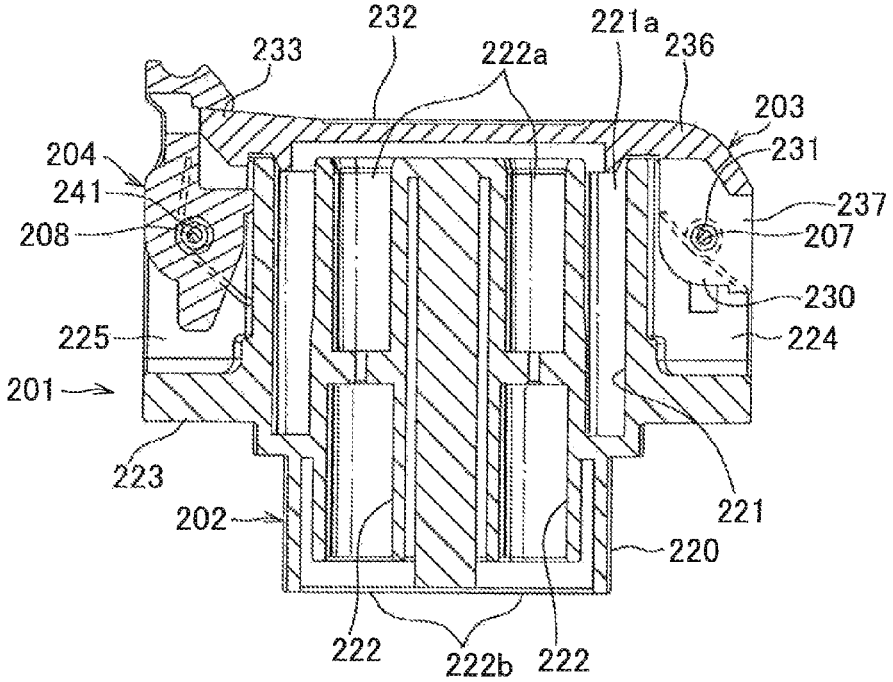
FIG. 8 PRIOR ART
FIG. 8 is a cross-sectional view illustrating a state that a cover of the connector shown in FIG. 7 covers an opening of a housing.
Figure 9:
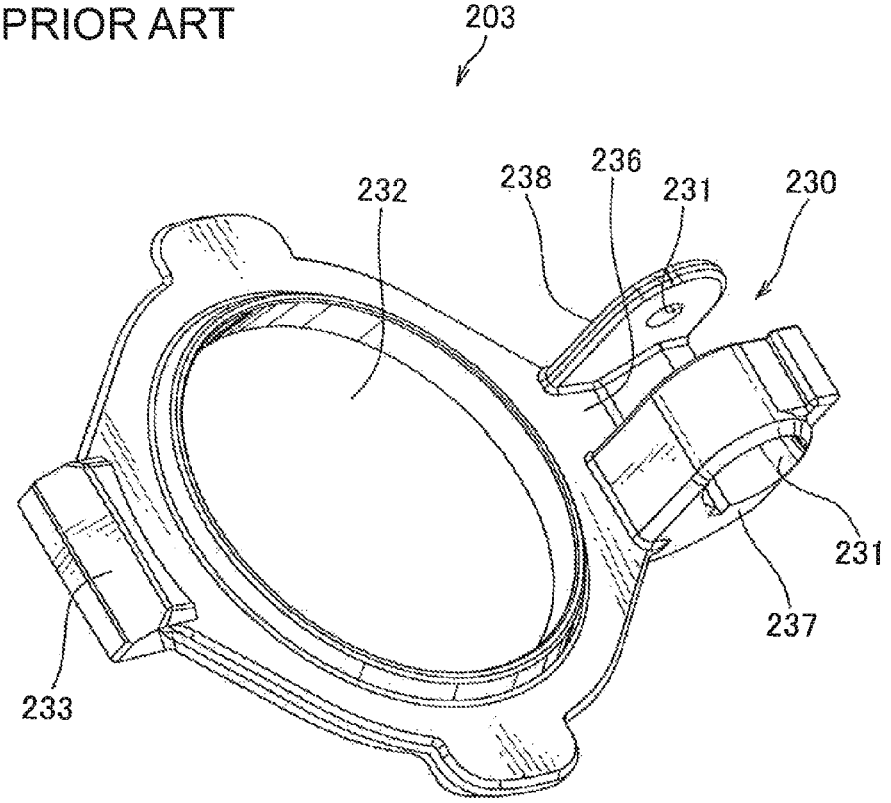
FIG. 9 PRIOR ART
FIG. 9 is perspective view illustrating the cover of the housing shown in FIG. 6.

The cover 3 is made of synthetic resin, and is, as shown in FIGS. 4 and 5, provided with a plate 32 overlaid on the upper end of the housing main body 20, an edge 33 disposed an outer edge of the plate 32, and a base 30 disposed at the outer edge of the plate 32 and opposed to the edge 33. The edge 33 as shown in FIG. 4, is positioned outside an outer wall of the housing main body 20. The edge 33 is as mentioned above engaged with the latch 4.

The base 30 as shown in FIG. 5, is provided with an extension 36 extending from the edge of the plate 32, a pair of shaft attachment plates 37, 38 upstanding from the extension 36 and opposed to each other, and a rib 35 upstanding form the extension 36 and arranged between the pair of shaft attachment plates 37, 38. The pair of shaft attachment plates 37, 38 is provided with shaft holes 31 through which the shaft 7 is passed. The rib 35 extends in a direction perpendicular to a direction in which the pair of shaft attachment plates 37, 38 are opposed to each other, of which a tip separated away from the extension 36 is peaked.

Such the cover 3, by the pair of shaft attachment plates 37, 38 being positioned between the pair of attachment plates 24 and by the shaft 7 being passed through the shaft holes 31 of the pair of shaft attachment plates 37, 38 and the shaft holes of the pair of attachment plates 24, is pivoted rotatably by the housing 2. The arrow A-B in FIG. 3 indicates a rotation direction of the cover 3.

The spring 5 is formed such that a wire is deformed plastically, wound spirally in multiple turns, and provided with a spiral part through which the shaft 7 is passed inside, a base side attachment part disposed at an end of the spiral part and arranged to be attached to the base 30, and a housing side attachment part disposed at the other end of the spiral part and arranged to be attached to the housing 2. The spring 5 biases the cover 3 in the arrow B direction in FIG. 3.

The latch 4 is made of synthetic resin and is provided with a base 40 having a shaft hole 41 through which the shaft 8 is passed, a holding claw 42 projecting from the base 40 and positioned near the outer face of the cover 3 with the openings 21*a*, 22*a* being covered, a projection 43 projecting from the base 40 and arranged near the shaft hole 41 more than the holding claw 42. The latch 4 is, by the base 40 being positioned between the pair of attachment plates 25 of the housing 2 and by the shaft 8 being passed through the shaft hole 41 of the base 40 and the shaft holes of the pair of attachment plates 25, pivoted rotatably by the housing 2. The arrow C-D in FIG. 3 indicates a rotation direction of the latch 4. Such the latch 4 as shown in FIG. 4, has the edge 33 of the cover 3 while covering the openings 21*a*, 22*a* positioned between the holding claw 42 and the projection 43 so as to be engaged with the edge 33.

The spring 6 is formed such that a wire is deformed plastically, wound spirally in multiple turns, and provided with a spiral part through which the shaft 8 is passed inside, a base side attachment part disposed at an end of the spiral part and arranged to be attached to the base 40, and a housing side attachment part disposed at the other end of the spiral part and arranged to be attached to the housing 2. The spring 6 biases the latch 4 in the arrow C direction in FIG. 3.

Then, a covering procedure of the cover 3 of the connector 1 is discussed. When closing the cover 3 that is now open, the cover 3 is, with the latch 4 rotated in the arrow D direction in FIG. 3 against biasing force of the spring 6, rotated in the arrow A direction in FIG. 3 against biasing force of the spring 5, and the latch 4 is released so that the latch 4 is engaged with the edge 33 of the cover 3. And when opening the cover 3 that is now closed, the latch 4 is rotated in the arrow D direction in FIG. 3 against biasing force of the spring 6. Namely, the latch 4 is released. The over 3 then opens automatically by biasing force of the spring 5 in the arrow B direction in FIG. 3.

In the aforementioned connector 1, during charging with the connector 9 of the charge cable plugged into the housing 2, water or snow accumulating between the pair of shaft attachment plates 37, 38 (K part in FIG. 1) is frozen, and then ice may be induced between the pair of shaft attachment plates 37, 38. Thereby in the conventional connector there has been drawback that the cover 3 cannot be closed because of the ice interfering with the cover 3. On the other hand, in the connector of the present invention, since the peaked rib 35 is disposed between the pair of shaft attachment plates 37, 38, when ice, with the cover 3 open is induced between the pair of shaft attachment plates 37, 38 by snowfall, rotation of the cover 3 in closing direction (the arrow A direction in FIG. 3) allows the ice to be broken so as to close the cover 3 readily.

Note that the above-mentioned embodiments merely show typical embodiment of the present invention, but the invention is not limited to the embodiments or the modifications. Namely, it is to be understood that various changes and modifications will be apparent to those skilled in the art. Therefore, unless otherwise such changes and modifications depart from the scope of the present invention hereafter defined, they should be construed as being included therein.

REFERENCE SIGNS LIST

1 connector
2 housing
3 cover
31 shaft hole
21*a*, 22*a* opening
35 rib
37, 38 shaft attachment plate

The invention claimed is:

1. A connector, comprising a housing; and a cover supported rotatably and pivotally by the housing and covering an opening of the housing, the cover provided with a plate to be overlaid on an upper end of the housing and a base, wherein the base includes an extension extending from an outer edge of the plate, a pair of shaft attachment plates provided with a shaft hole with a shaft passing therethrough, and a rib arranged between the pair of shaft attachment plates and made peaked, the rib upstanding from the extension in a direction perpendicular to a direction in which the pair of shaft attachment plates are opposed to each other.

2. The connector of claim 1, wherein the rib is offset from the shaft.

* * * * *